US008910328B2

(12) United States Patent
Clenet

(10) Patent No.: US 8,910,328 B2
(45) Date of Patent: Dec. 16, 2014

(54) ARTICULATING BED WITH FLEXIBLE MATTRESS SUPPORT

(71) Applicant: Ergomotion, Inc., Santa Barbara, CA (US)

(72) Inventor: Alain Clenet, Santa Ynez, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 0 days.

(21) Appl. No.: 13/946,970

(22) Filed: Jul. 19, 2013

(65) Prior Publication Data

US 2014/0020182 A1 Jan. 23, 2014

Related U.S. Application Data

(60) Provisional application No. 61/673,878, filed on Jul. 20, 2012.

(51) Int. Cl.
*A61G 7/015* (2006.01)

(52) U.S. Cl.
CPC ..... *A61G 7/015* (2013.01)
USPC ..... 5/613; 5/617; 5/618; 5/612; 5/616; 5/600

(58) Field of Classification Search
USPC ..... 5/618, 617, 616, 613, 612, 600, 5/620–622, 632–634, 640, 722, 723, 933, 5/934, 937, 236.1
See application file for complete search history.

(56) References Cited

U.S. PATENT DOCUMENTS

| | | | |
|---|---|---|---|
| 5,377,373 | A | 1/1995 | Shirai |
| 6,276,011 | B1 | 8/2001 | Antinori |
| 7,540,048 | B2 | 6/2009 | Piraino |
| 2004/0103476 | A1 | 6/2004 | Barcesat |
| 2009/0178201 | A1 | 7/2009 | Lujan |

*Primary Examiner* — Peter M Cuomo
*Assistant Examiner* — Brittany Wilson
(74) *Attorney, Agent, or Firm* — Felix L. Fischer

(57) ABSTRACT

An articulating bed incorporating a frame having side frame members and a rigid cross frame member extending between the side frame members employs a flexible support member secured to the rigid cross frame member. Support arms engage an upper body portion of the flexible support member with lubricious support and are rotatable through a range of motion from an aligned position with the side frame members to a fully elevated position angularly supporting the upper body portion in a raised position. A leg portion adjustment member engages the flexible support member at a knee position intermediate a thigh portion and a leg portion of the flexible support member. The leg portion adjustment member is rotatable through a range of motion from an aligned position with the side frame members to a fully elevated position placing the knee position at an elevated location with angular positioning of the thigh portion and leg portion.

10 Claims, 20 Drawing Sheets

ARTICULATING BED WITH FLEXIBLE MATTRESS SUPPORT

REFERENCE TO RELATED APPLICATIONS

This application claims priority of U.S. Provisional Application Ser. No. 61/673,878 filed on Jul. 20, 2012 entitled ARTICULATING BED WITH FLEXIBLE MATTRESS SUPPORT and having a common assignee with the present application, the disclosure of which is incorporated herein by reference.

BACKGROUND

1. Field

This invention relates generally to the field of adjustable beds and more particularly to a structure for an articulating bed having an integral adjustable lumbar support and head angle adjustment with a flexible mattress support.

2. Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation. However, the articulating elements are typically rigid elements that extend in both a lateral and longitudinal dimension. These rigid elements may restrict the shaping of the mattress and create zones in the bed that are not ergonomically ideal.

One noted disadvantage of articulating bed systems when both the upper body positioning element and the leg positioning elements are elevated is the tendency for positioning of the lower back in a curved posture which may result in undesirable lumbar strain. Lumbar positioning or support elements have been proposed. However, adjustment elements have tended to adversely reposition, strain or damage the mattress.

Similarly, head angle with most articulated beds with the upper body positioning element in the elevated position is not satisfactory due to the linear alignment of the head and body. Adjustment systems for creating an angled relationship between the upper body portion of the mattress and a portion wherein the head rests have also been available but actuation systems have proved to be complicated or unsightly since the upper body portion articulating element is exposed in the elevated position It is therefore desirable to provide an articulating bed having a flexible mattress support member and providing lumbar support adjustment with reduced mattress interference and a head portion adjustment with simple and unimposing actuation elements.

SUMMARY

The embodiments disclosed herein overcome the shortcomings of the prior art by providing an articulating bed incorporating a frame having side frame members and a rigid cross frame member extending between the side frame members which employs a flexible support member secured to the rigid cross frame member. Support arms engage an upper body portion of the flexible support member with lubricious support and are rotatable through a range of motion from an aligned position with the side frame members to a fully elevated position angularly supporting the upper body portion in a raised position. A leg portion adjustment member engages the flexible support member at a knee position intermediate a thigh portion and a leg portion of the flexible support member. The leg portion adjustment member is rotatable through a range of motion from an aligned position with the side frame members to a fully elevated position placing the knee position at an elevated location with angular positioning of the thigh portion and leg portion.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
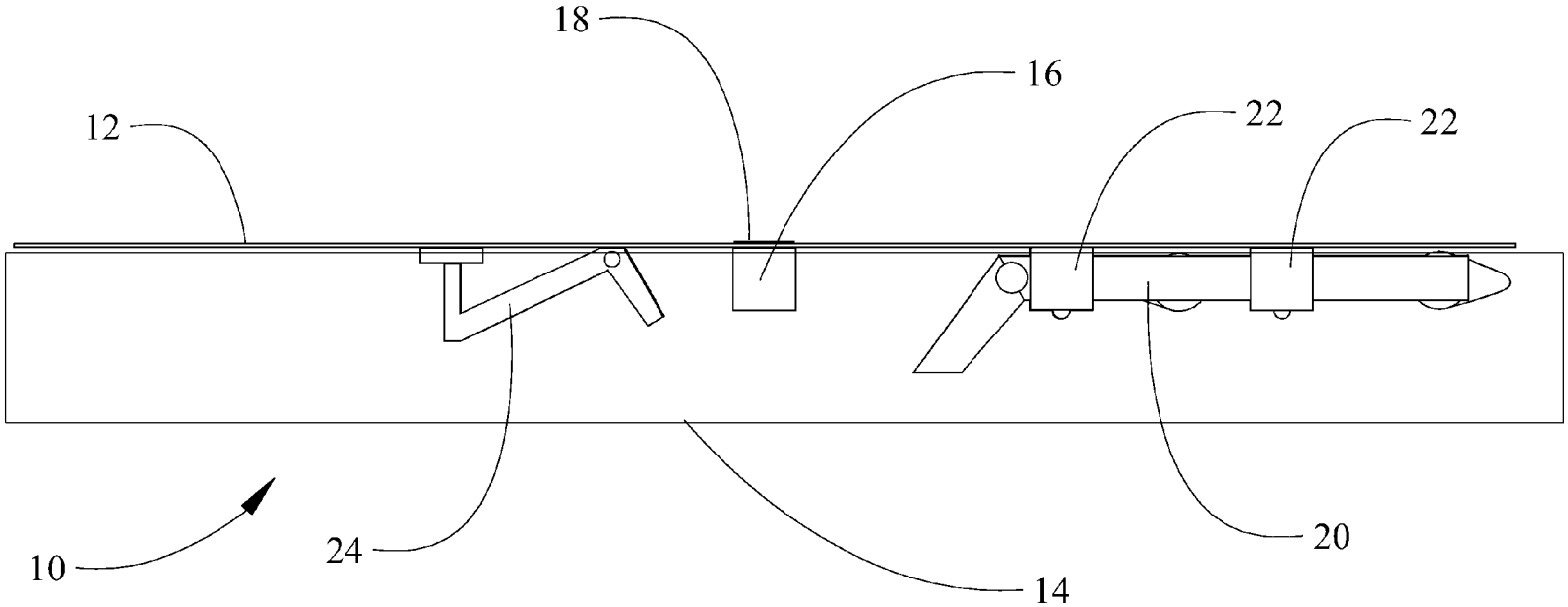
FIG. 1 is a side view of the adjustable bed system without side supports and the flexible member flat.
Figure 2:
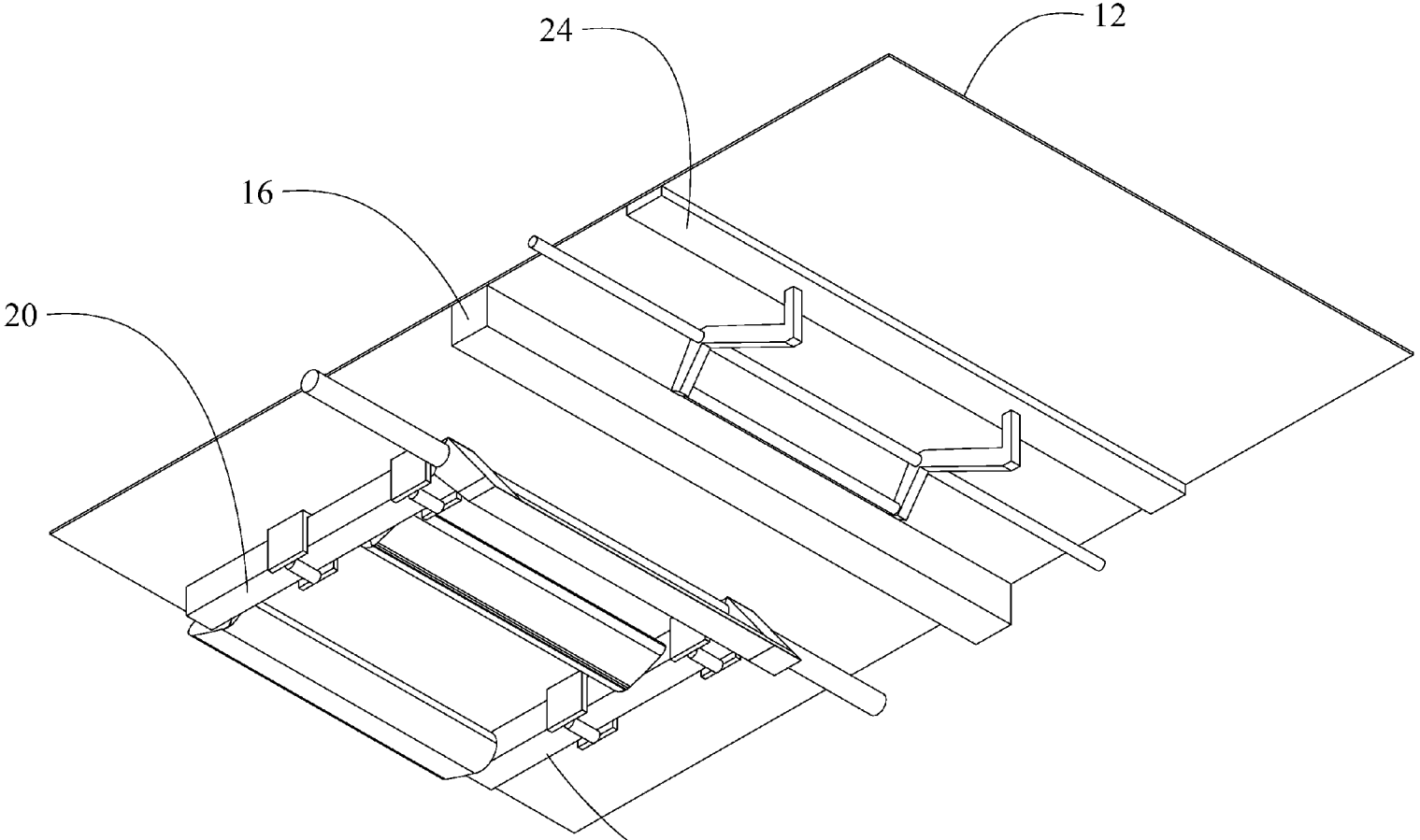
FIG. 2 is a pictorial view from under the bed.
Figure 3:
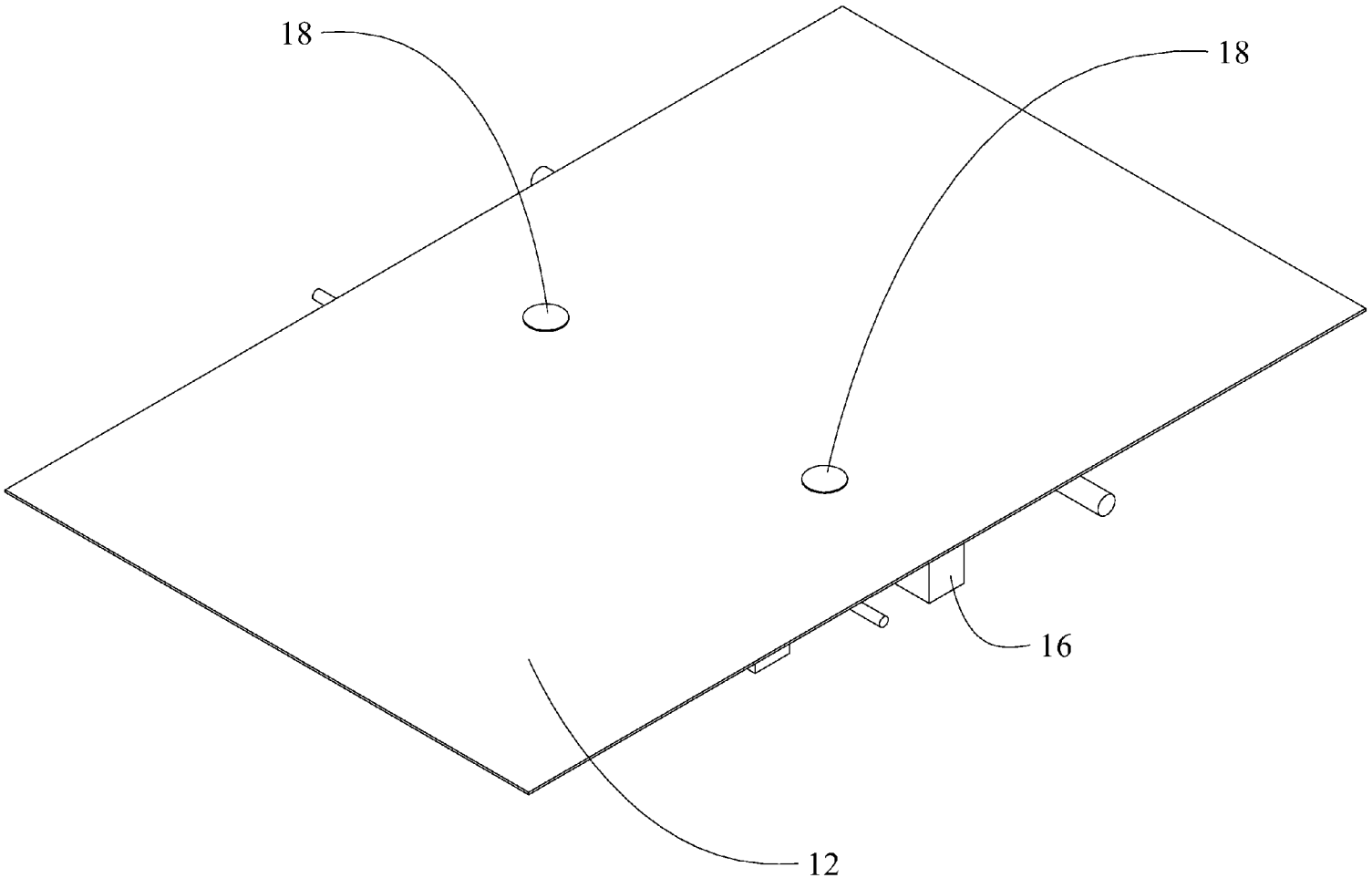
FIG. 3 is a top pictorial view of the bed with the flexible member flat showing the securing discs.

Embodiments shown in the drawings and described herein provide an actuation system for an articulating bed which eliminates the rigid individual support platforms and uses a continuous flexible support member for the mattress. Referring to the drawings, FIGS. 1 and 2 show the adjustable bed system 10 which incorporates a flexible support or member 12 to support a mattress (shown in later figures). The flexible support in an exemplary embodiment is a ⅛ inch sheet of fiber reinforced plastic (FRP) which is fire resistant (FR). Side frame members 14 support a cross member 16 to which the flexible member 12 is secured using plates or discs 18 (best seen in FIG. 3) with bolts extending through the FRP. Rotatable upper body support arms 20 support an upper body portion 13 of the flexible support member 12 toward the upper end of the bed. The flexible support member 12 is lubriciously supported on the support arms 20 to reposition itself during motion of the support arms. In one example embodiment, shuttles 22 which are supported on the support arms 20 are attached to the flexible support member 12. A leg portion adjustment member 24 is positioned to contact the flexible support member at approximately the knee position 25 of a user between a thigh portion 15 and lower leg portion 19 of the flexible support member 12. The side frames may include insets which receive the edges of the flexible support member 12 in the flat condition.

Figure 4:
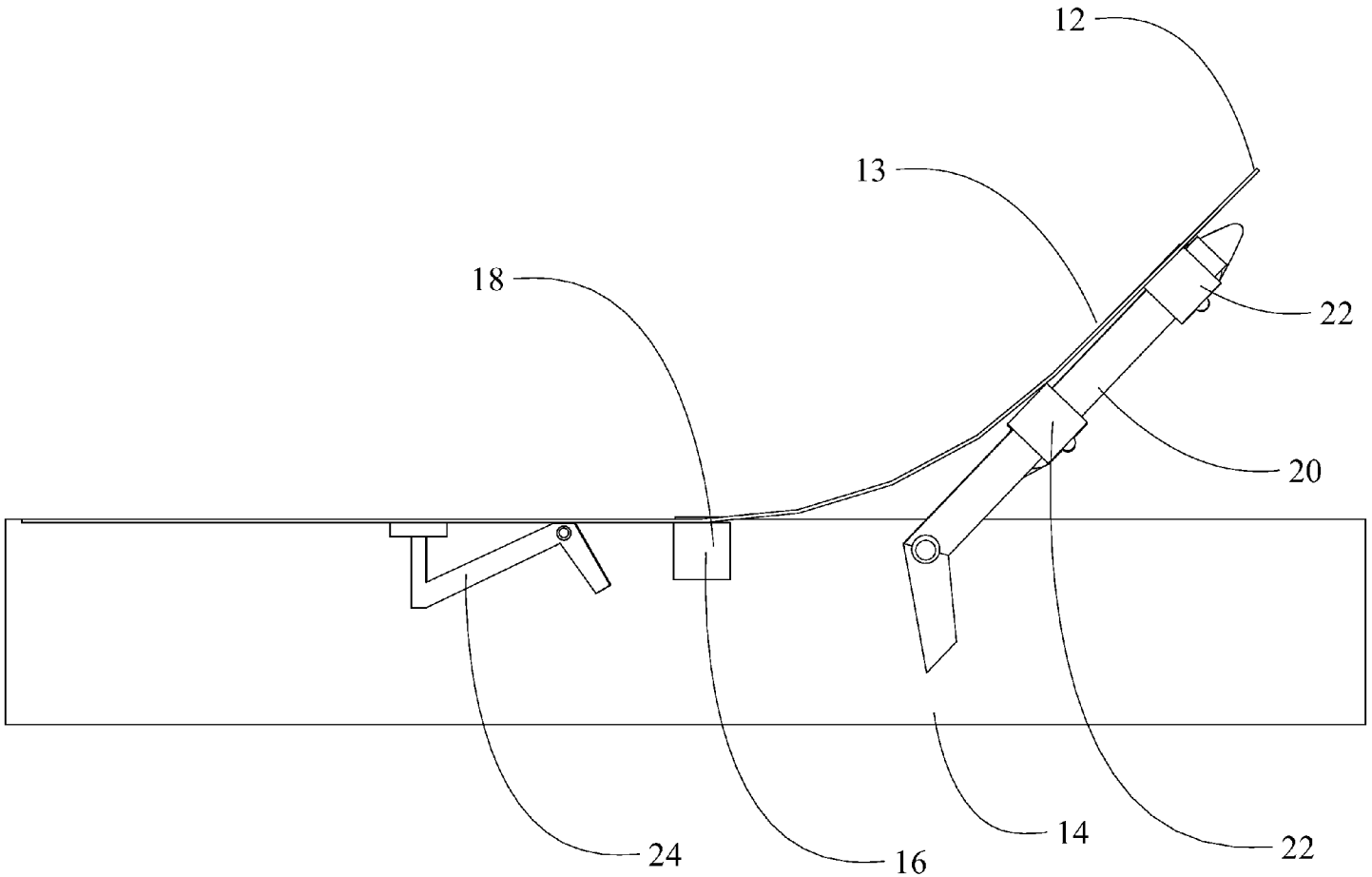
FIG. 4 is side view of the adjustable bed system with the upper body portion raised.
Figure 5:
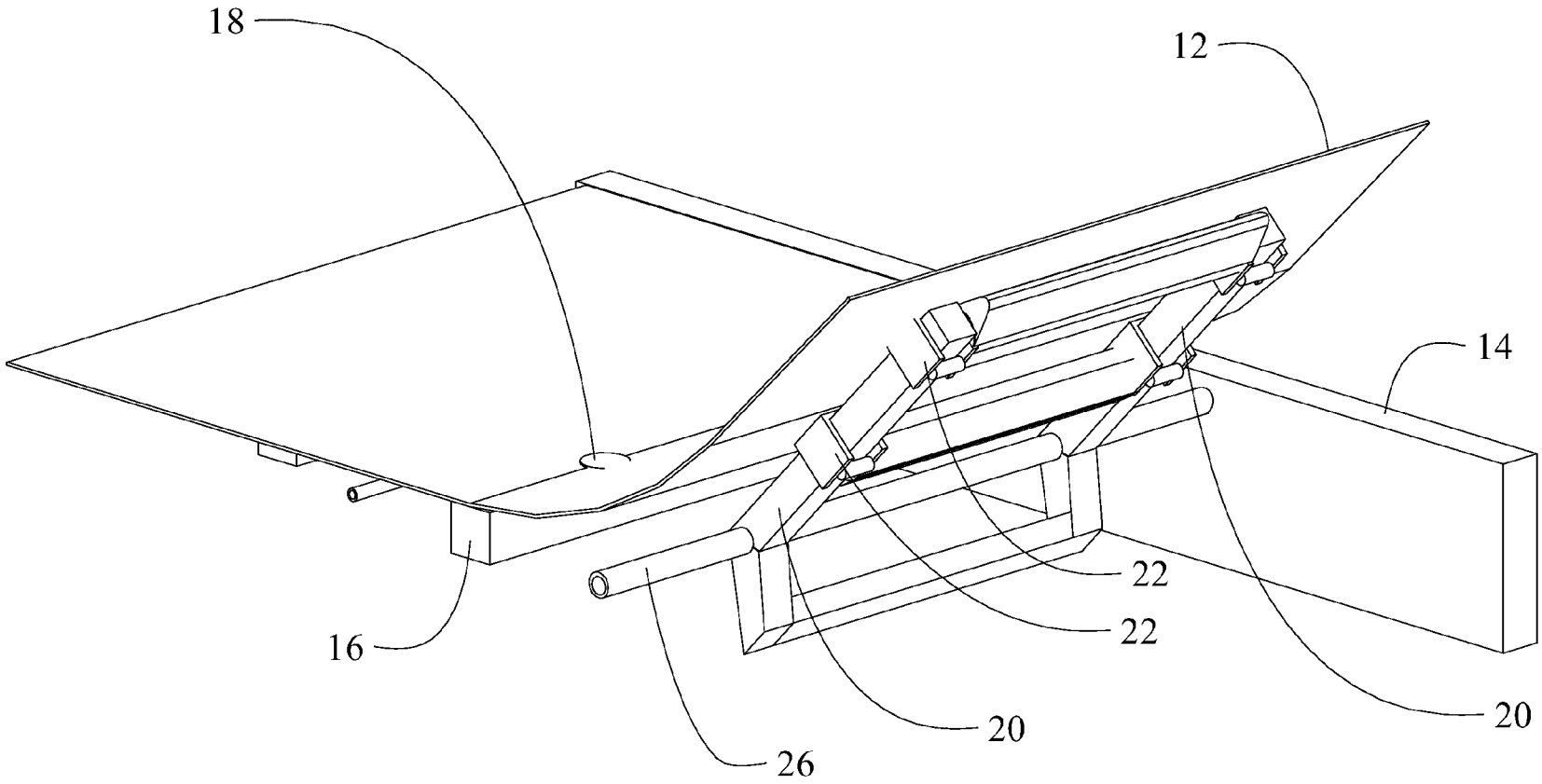
FIG. 5 is a pictorial view of the bed with the head portion raised.

As seen in FIGS. 4 and 5, the upper body portion 13 of the flexible support member 12 may be raised by rotating the upper body support arms 20 about axles 26 extending to and supported by the side frame members 14. Actuation levers 21 on the support arms 20 may be attached to an actuator 23 for rotation. The shuttles 22 reciprocate along the support arms 20 to maintain the flexible support member 12 in contact with the support arms at desired points for proper shaping of the mattress including extension of lumbar and neck angle adjustment elements as will be described in greater detail subsequently.

Figure 6:
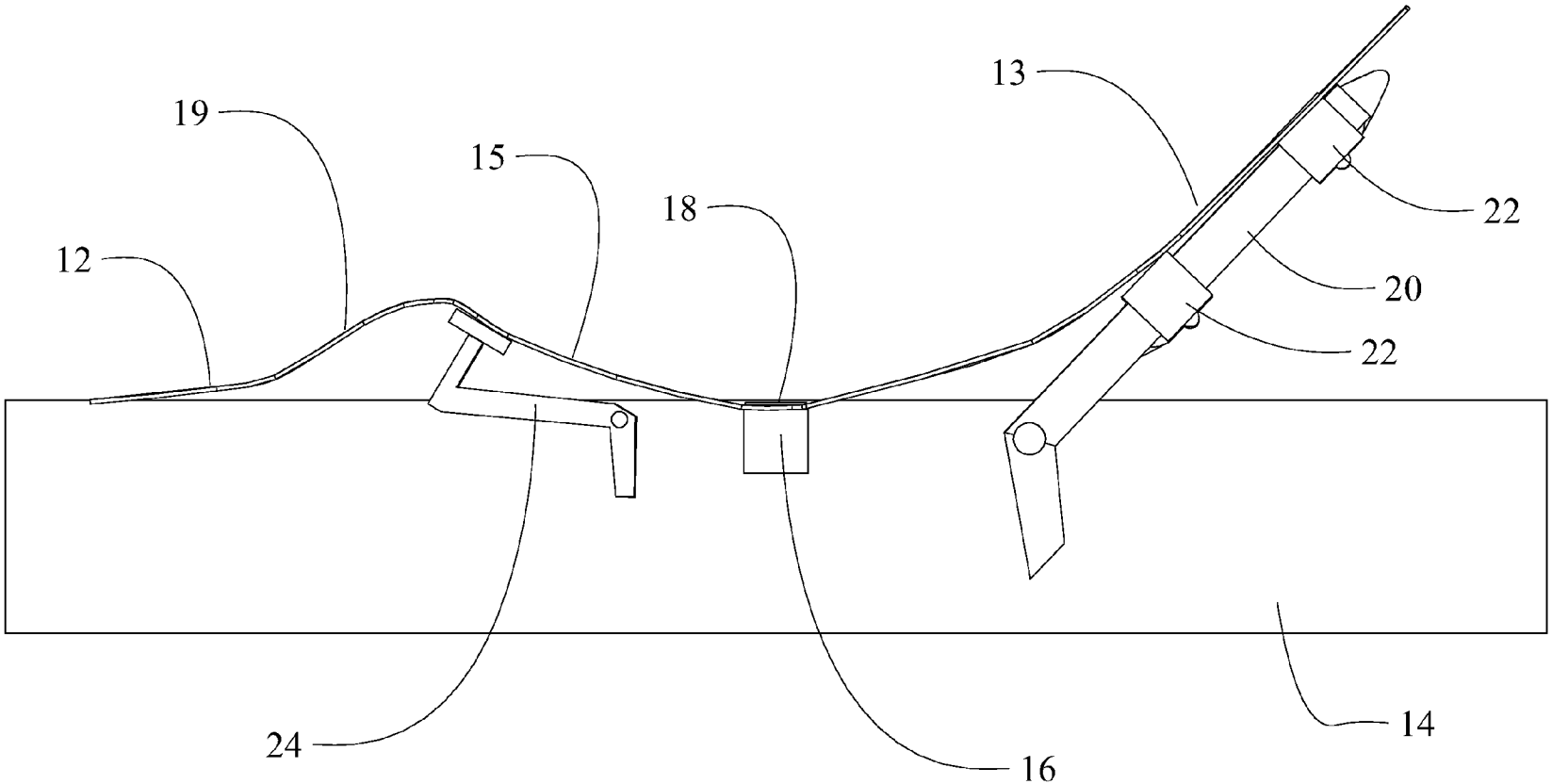
FIG. 6 is a side view of the bed with the head portion and leg portion raised.
Figure 7:
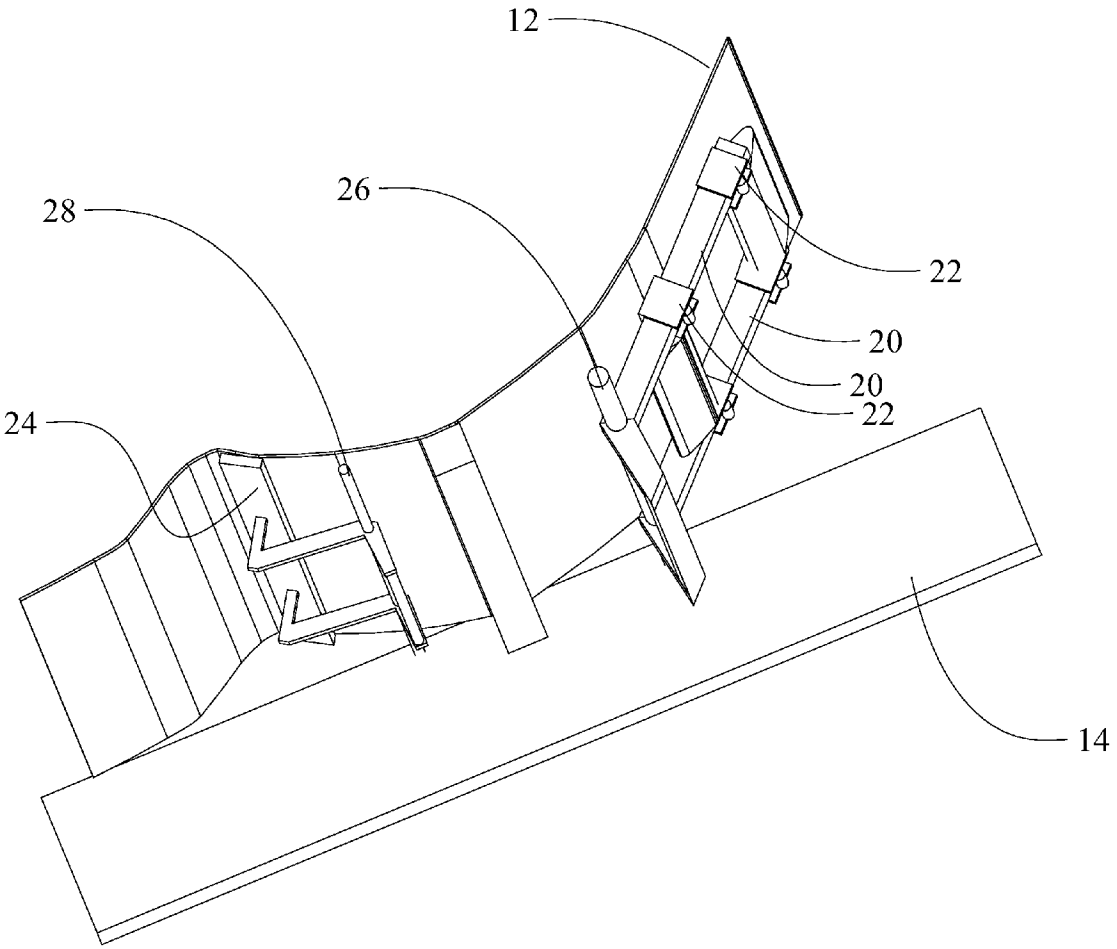
FIG. 7 is a pictorial view of the bed with the head and leg portions raised
Figure 8:
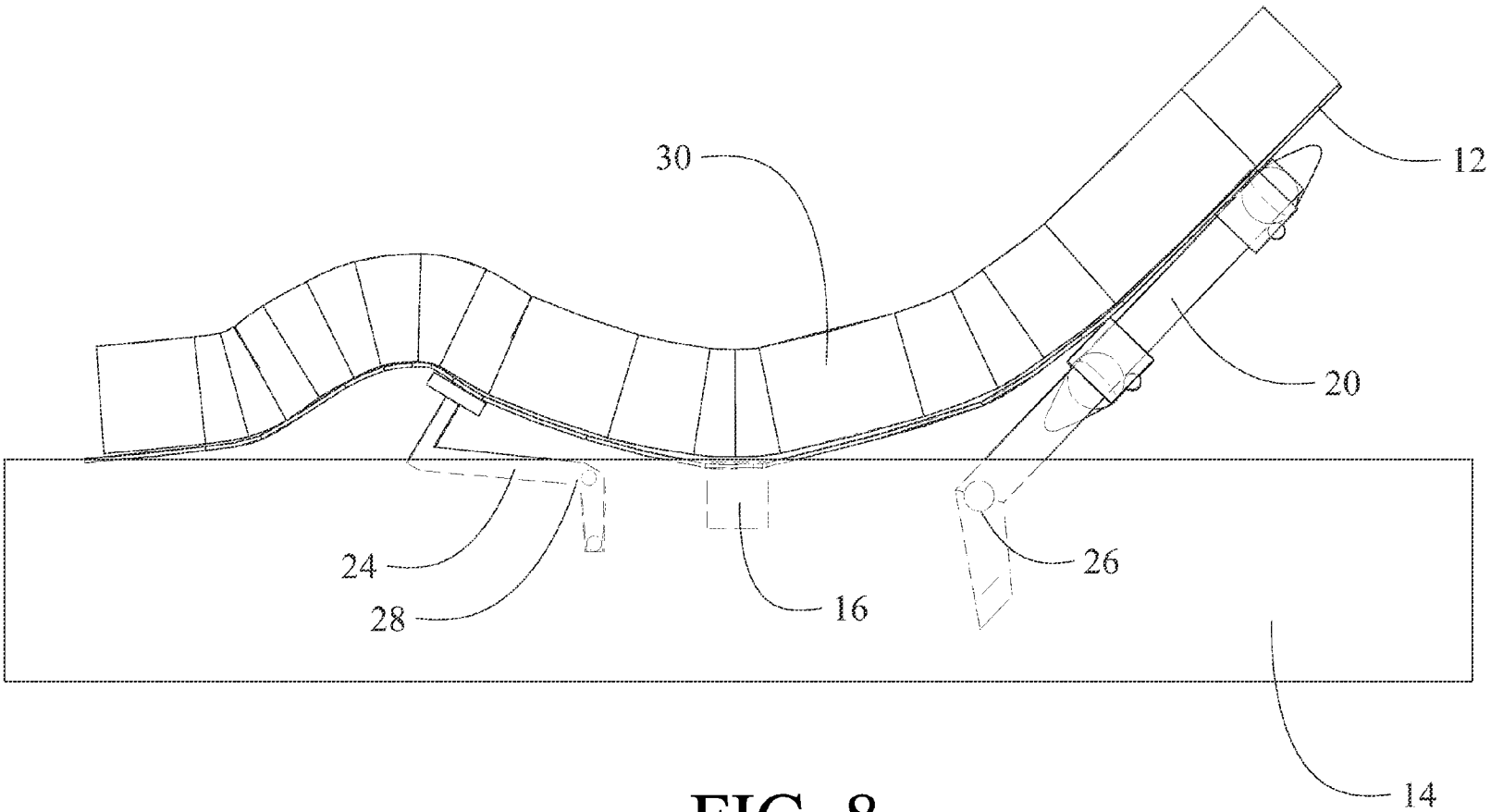
FIG. 8 is a side hidden line view of the bed with the head and leg portions raised and a mattress in place.
Figure 9:
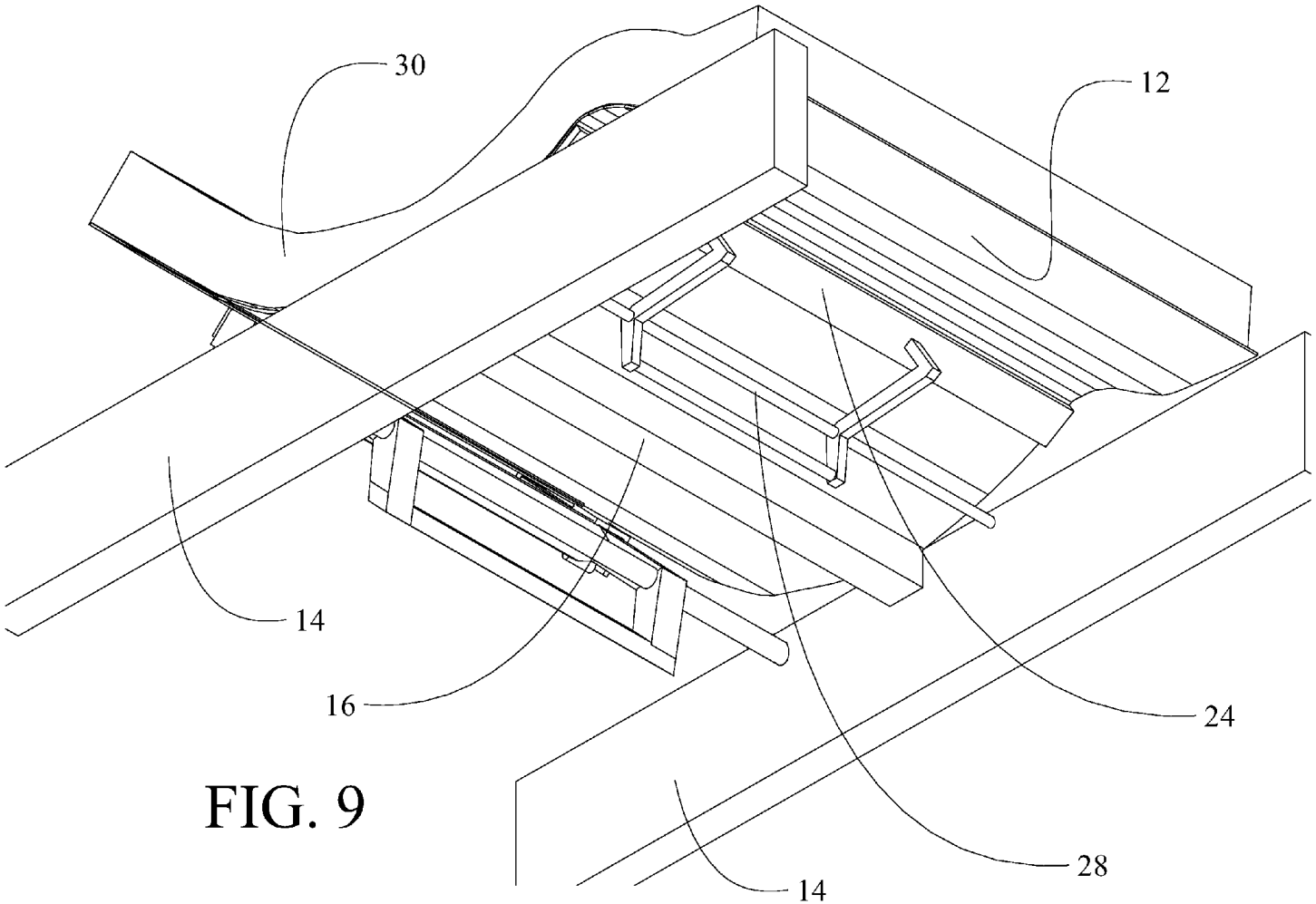
FIG. 9 is a pictorial view with the mattress in place.

As shown in FIGS. 6 and 7, the leg portion adjustment member 24 may be rotated about axle 28 which raises the flexible support member 12 at the knee position of the user. The flexible support member 12 flexes over the rotated leg portion adjustment member seeking a neutral position with the thigh portion 15 and lower leg portion 19 draped over the leg portion adjustment member 24. The flexible support member 12 establishes a smooth curvature in both the upper body portion 13 and thigh and lower leg portions 15, 19 of the bed based on natural flexing with the center of the member secured at the rigid cross member 16. FIGS. 8 and 9 show the bed in the actuated position for both the upper body portion and leg portion with a mattress 30 resting on the flexible support member 12. In prior art beds, mattresses tend to lift from the support platforms in the articulated position. The flexible support member 12 naturally contours the angles of the articulation to better maintain the positioning of the mattress on the support member. In addition, mattress retainers such as those disclosed in US patent application Ser. No. 13/367,616 entitled Mattress Retainer System for an Adjustable Bed having a common assignee with the present application, the disclosure of which is incorporated herein by reference, may be used to constrain the mattress to the flexible support member 12 at the head and foot.

Figure 10:
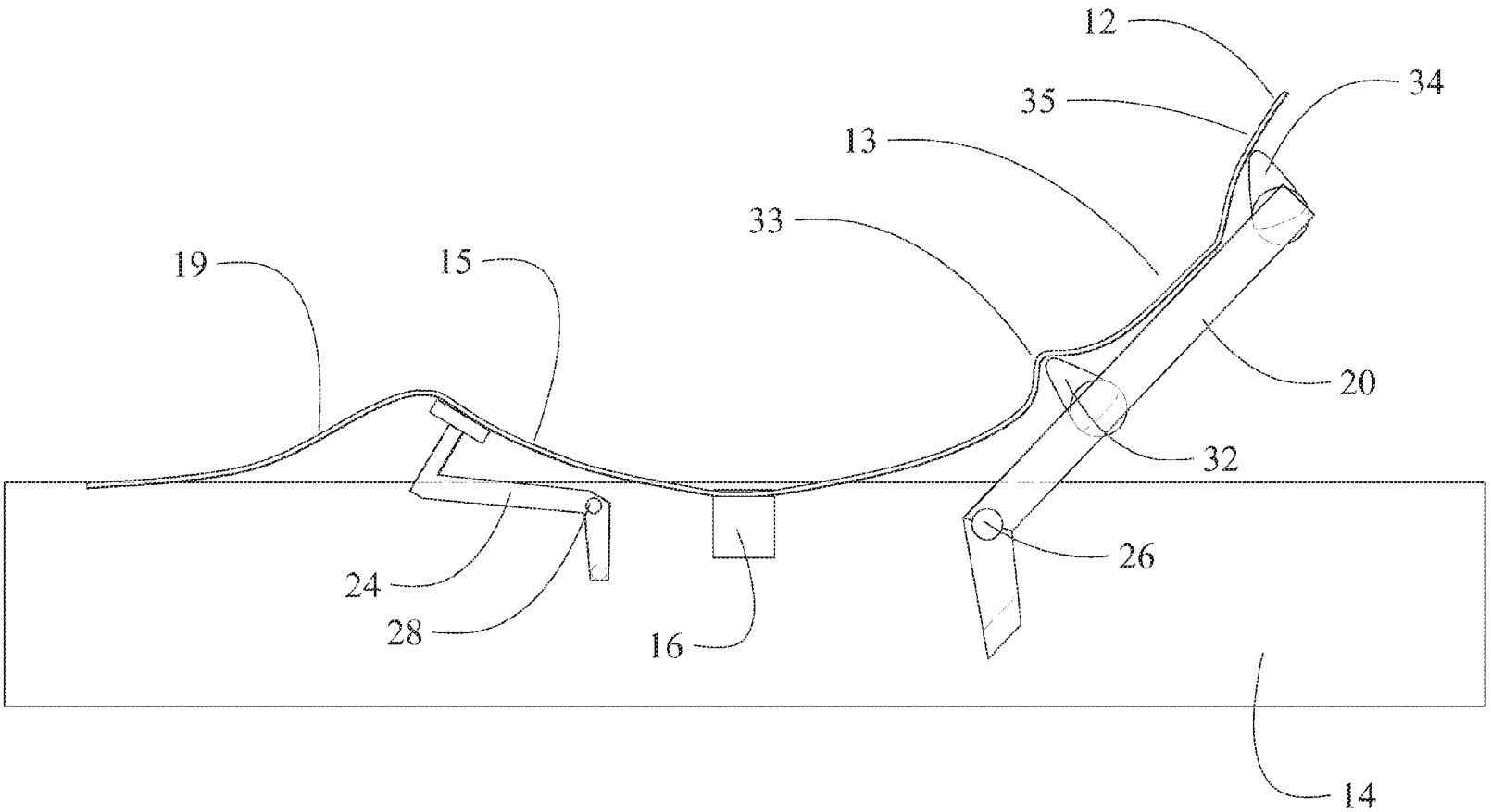
FIG. 10 is a side hidden line view of the bed with the head adjustment and lumbar adjustment activated.
Figure 11:
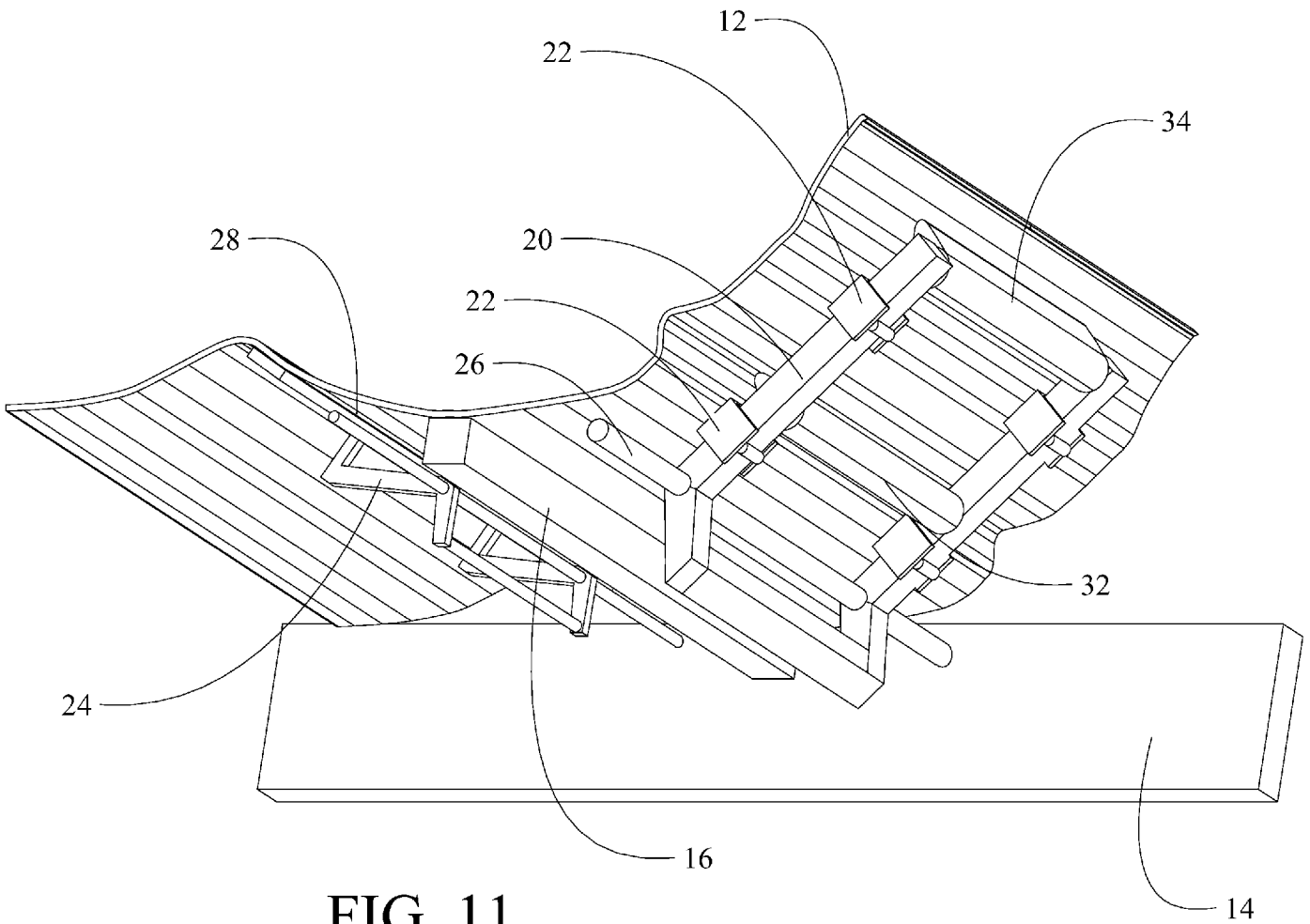
FIG. 11 is a pictorial view with the head adjustment and lumbar adjustment activated.
Figure 12:
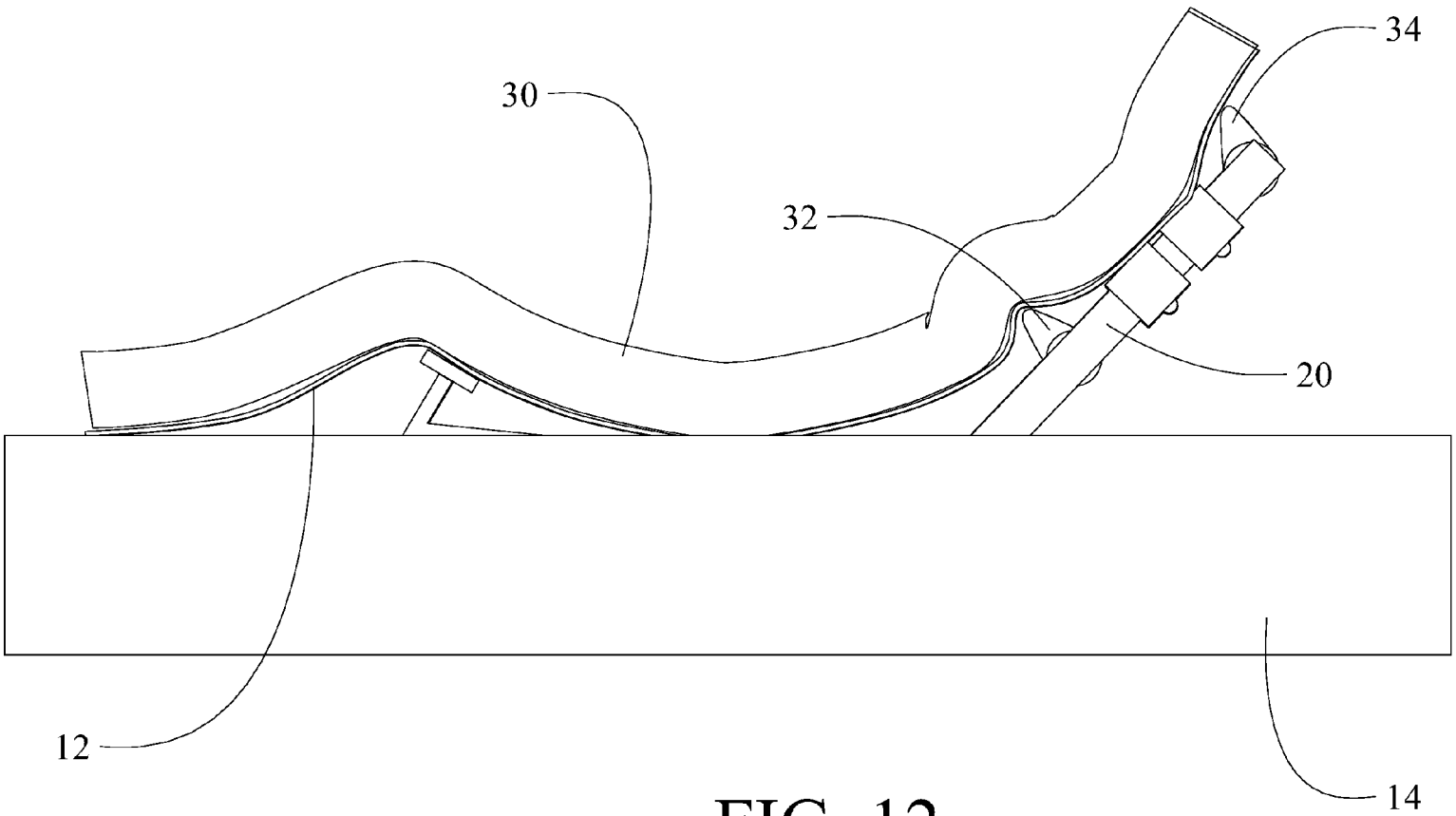
FIG. 12 is a pictorial view as in FIG. 11 with a mattress installed.

Additionally, the flexible nature of the flexible support member 12 allows the addition of specific contouring elements for lumbar support and head angle position. As shown in FIGS. 10 and 11, a lumbar positioning element is provided by a first rotatable cam element 32 attached between the upper body support arms 20 is rotated to flex the flexible support member 12 outward in a lumbar portion 33. As shown in FIG. 12 the mattress 30 adopts the flexed position providing gently curving additional support in the lumbar region of the users back. Similarly, a neck angle adjustment element is provided by a second rotatable cam element 34 attached between the upper body support arms 20 rotatable to flex the flexible support member 12 outward in a head portion 35 to provide additional angled support for the users head.

Figure 13A:
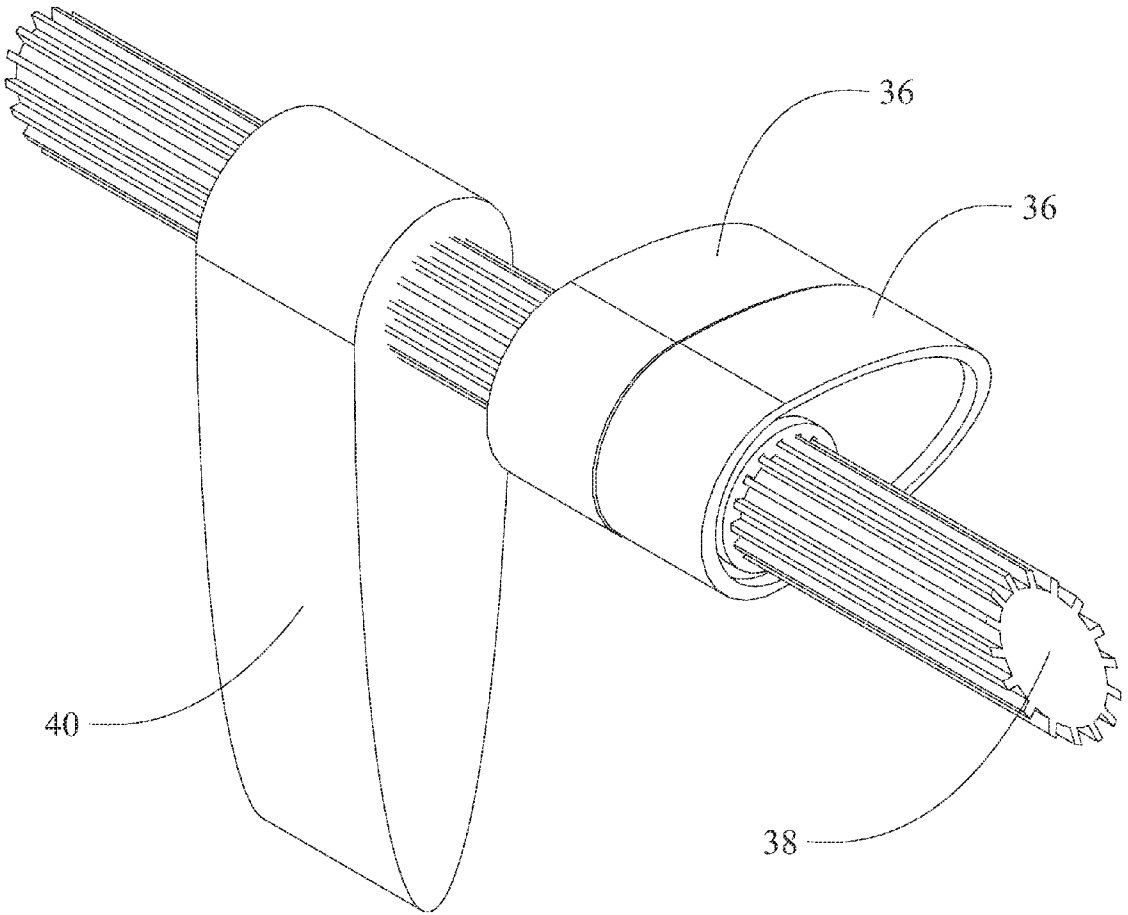
FIG. 13A is an isometric view of an exemplary components for the cam element.
Figure 13B:
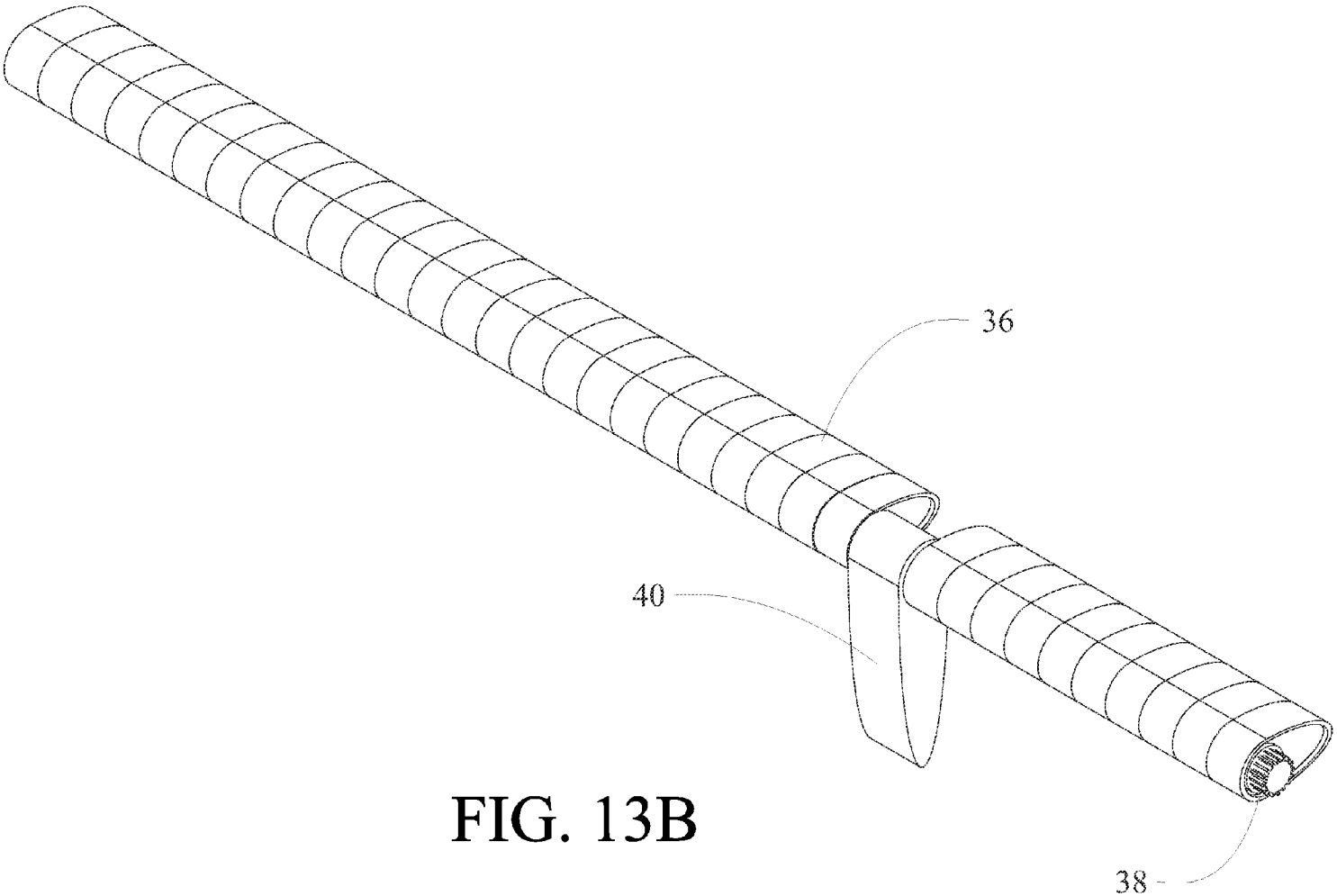
FIG. 13B is an isometric view of the cam element with a rotation lever incorporated.

The cam elements 32, 34 may be formed from multiple cam segments 36 as shown in FIG. 13A which are mounted on a splined shaft 38 to create a cam element of the desired width for the articulating bed. A rotation lever 40 adapted to receive the splined shaft may be interspersed in the cam elements at a desired location for attachment to an actuator as shown in FIG. 13B. In alternative embodiments, one cam segment may integrate the rotation lever. Rotation of the splined shaft results in concerted rotation of the multiple cam segments. Additionally, while shown in the drawings as extending the entire width of the splined shaft, the cam segments 36 may be positioned over only a portion of the shaft width to tailor the lumbar or neck angle adjustment cam elements to engage a portion or selected portions of the flexible support member 12 and hence the mattress.

Figure 14A:
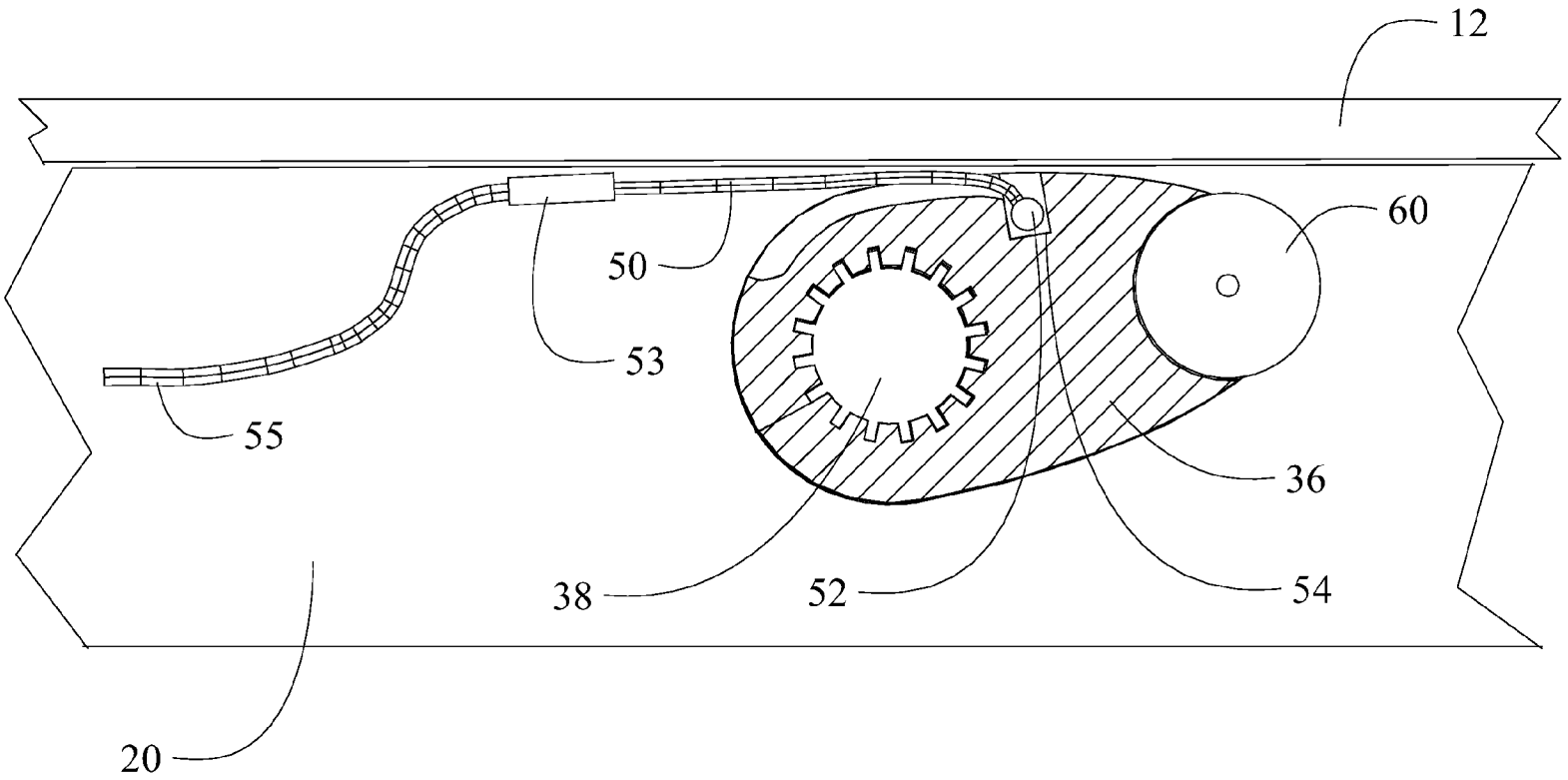
FIG. 14A is an isometric view of an alternative cable actuation system for the cam element.
Figure 14B:
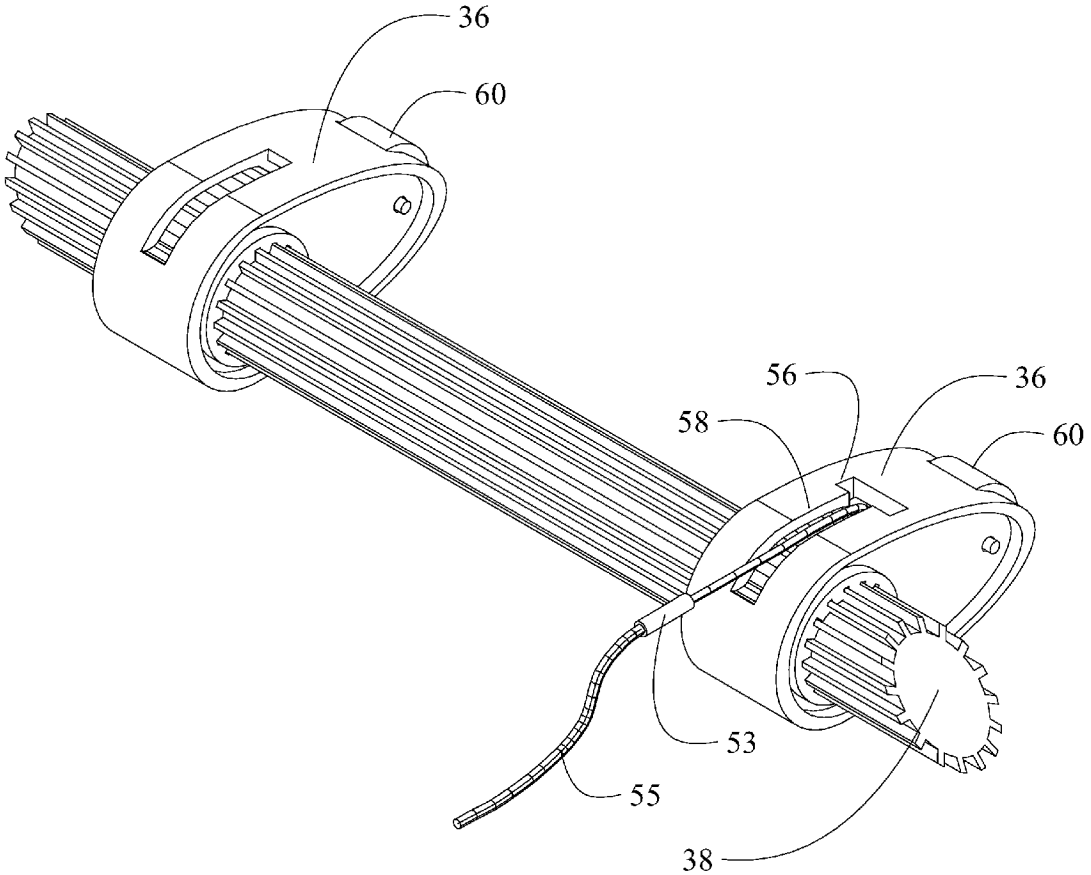
FIG. 14B is an isometric view of the assembled cam element of FIG. 14A.
Figure 14C:
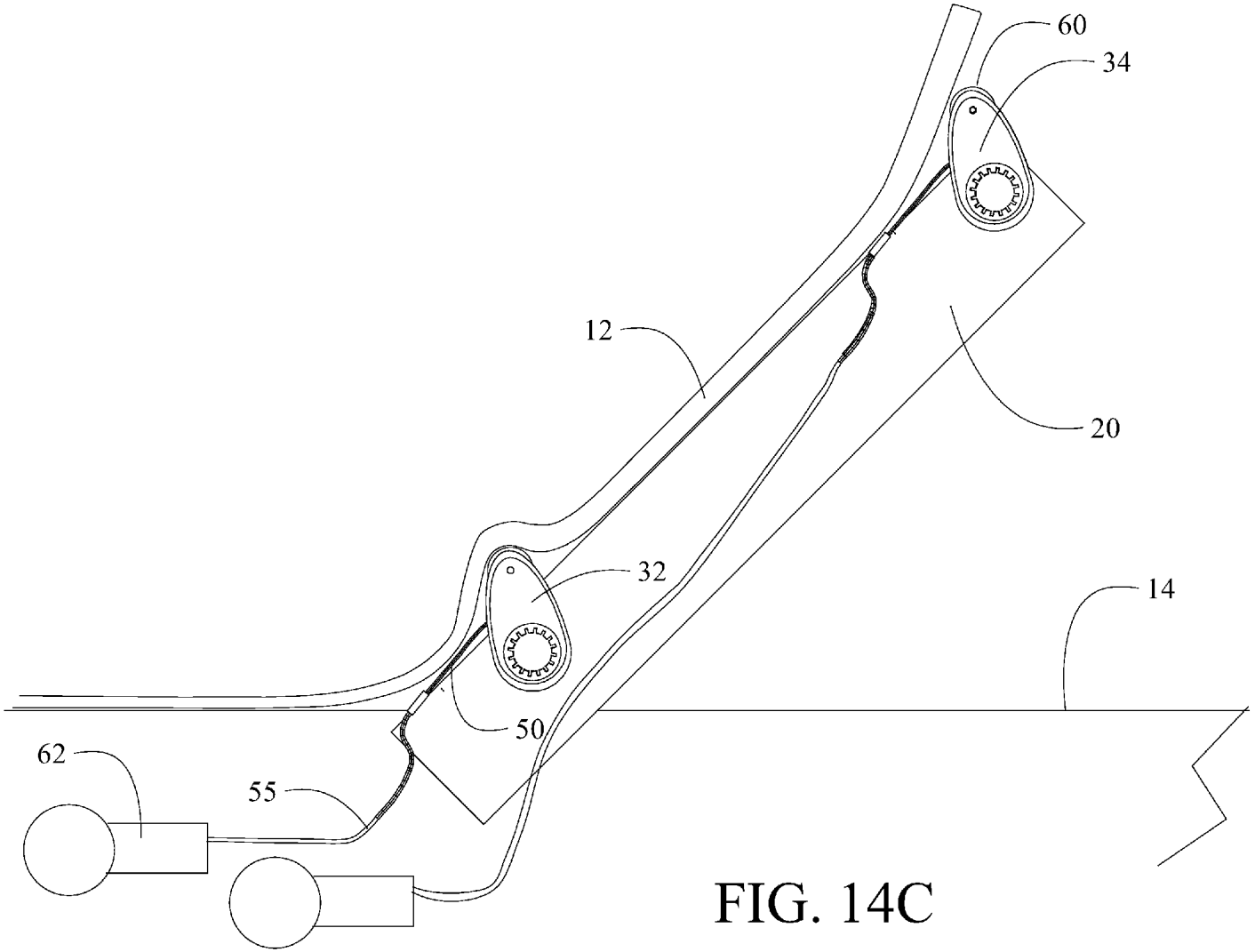
FIG. 14C is a side view of the actuator arrangement for the cable actuation system.

Actuation of the cam elements is accomplished in alternative embodiments through the use of a sheathed cable 50 as shown in FIGS. 14A-C. The cam segment 36 engages a key 52 on the end of cable 50 in a relief 54. A lateral slot 56 allows installation of the key into the relief while an adjoining longitudinal slot 58 engages the cable for operation. A securing lug 53 on a sheath or housing 55 for the cable attached to the support arm 20 provides actuation support for the cable. As shown in FIG. 14B, the cable 50 extends from the cam segment and, upon tensioning of the cable rotates the cam segment and splined shaft 38 which in turn rotates additional cam segments. Relaxation of the tension on the cable allows the cam segments to rotate back to a flush position with the support arms 20 as shown in FIG. 14A. Engagement of the flexible support member 12 by the cam segments may rely on lubricious surface engagement between the cam segments and the under surface of the flexible support member or wheels 60 may be included on the engagement ends of the cam segments as shown in FIGS. 14A and 14B. Cables for actuation of both the lumbar positioning first cam element 32 and the head angle positioning second cam element 34 may be routed to actuators mounted remotely from the actual cam elements. Use of the cable for actuation of the cam element allows placement of an actuator 62 within the frame on the side frame member 14 or other hidden location for actuation through tensioning of the cable providing a very clean appearance for the exposed structure of the articulated bed as shown in FIG. 14C.

Figure 15:
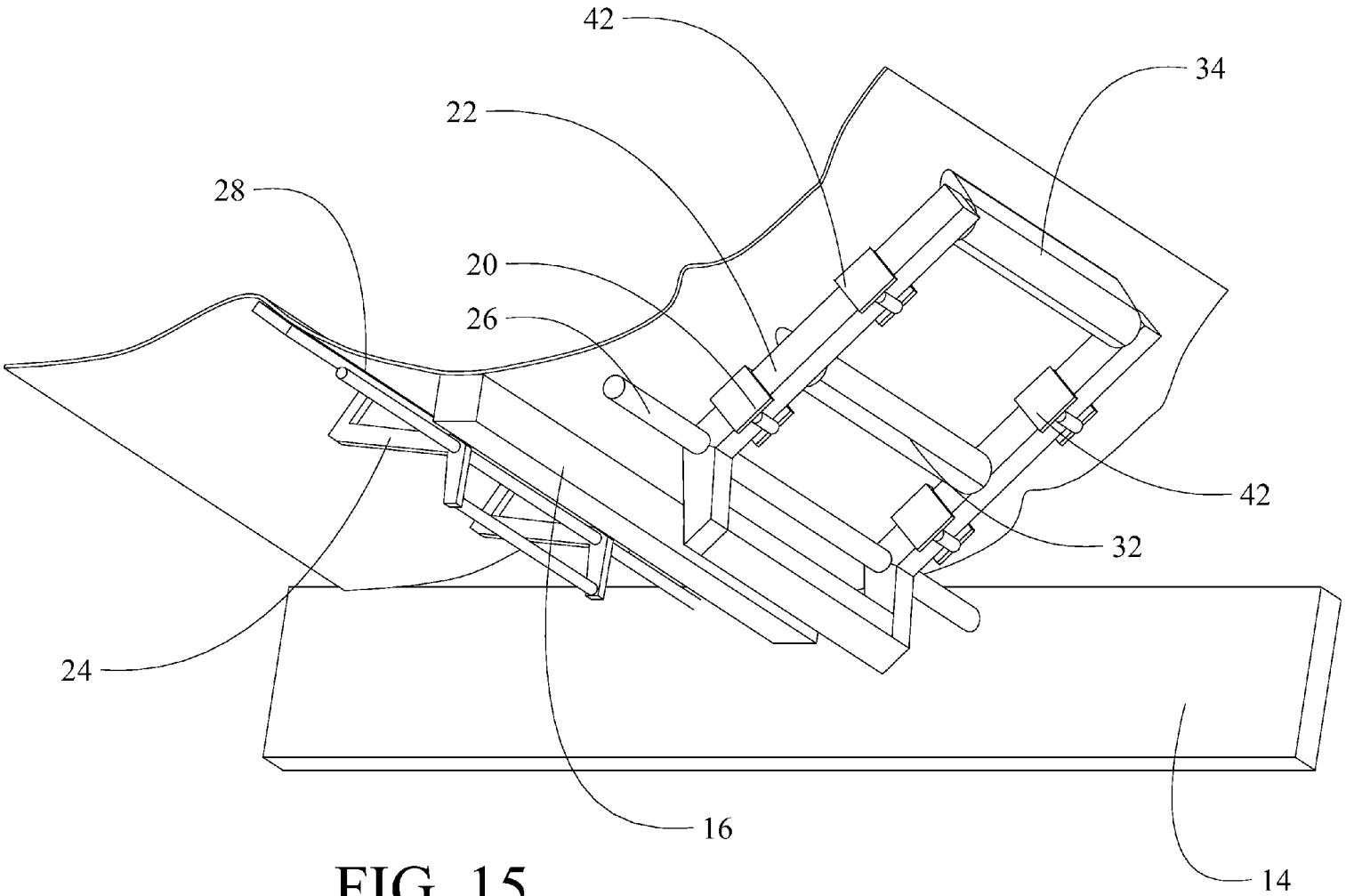
FIG. 15 is an alternative embodiment of the support arm shuttle.

Shaping of the displacement of the flexible support member 12 by the cam elements 32, 34 for the lumbar and neck angle support is accomplished by positioning and constraint of the shuttles 22 on the support arms 20. As shown in FIG. 15, the multiple shuttles shown in FIGS. 1-11 may be replaced by a single shuttle 42 on each support arm intermediate the lumbar cam element 32 and neck angle cam element 34. Motion of the shuttle 42 is constrained between the lumbar cam element 32 and neck angle adjustment cam element 34 thereby naturally shaping the flexible support member over the cam elements when activated. Constraint of the flexible support member 12 at the shuttle 42 and rigid cross member 16 provides shaping of the flexible support member in response to rotation of the lumbar cam element as shown in FIG. 15.

Figure 16:
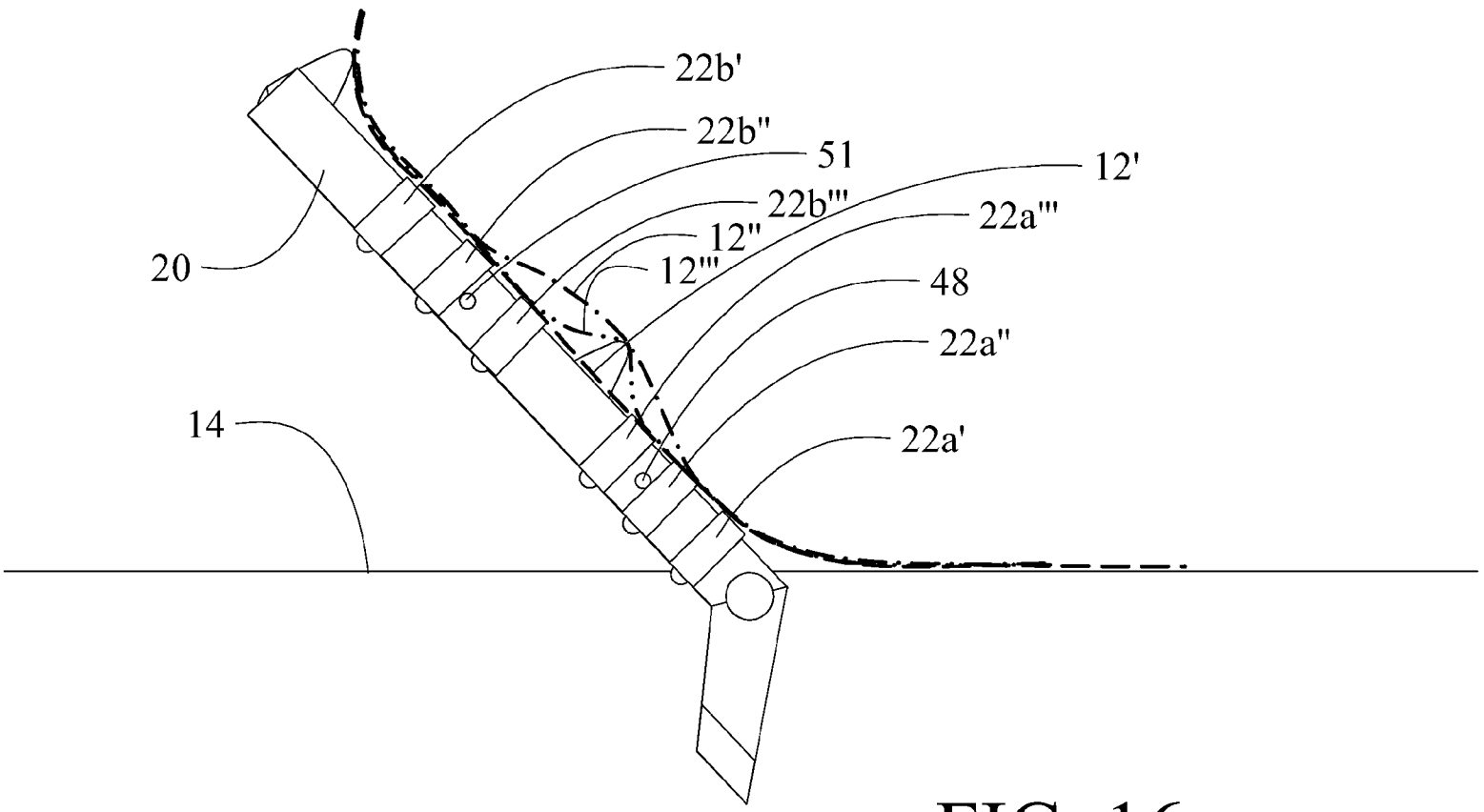
FIG. 16 is a side view of the shuttles at various positions for constraining the lumbar support shape; and, FIG. 17 is a side view of an alternative embodiment for the leg portion adjustment.

Alternatively one or both of the shuttles 22*a* and 22*b* may be constrained for motion along the support arms 20 at defined extents to provide specific shaping curvature of the flexible support member 12 in response to adjustment of the lumbar and neck angle cam elements. As an example, as shown in FIG. 16, shuttle 22*a* may be unconstrained in a lower initial position 22*a*' in response to a first retracted position of the lumbar support with shuttle 22*b* unconstrained in an upper position 22*b*'and the flexible support flat as shown by profile 12'. Upon rotation of the lumbar support cam element 32 into an extended position, shuttle 22*a* is drawn upward along the support arm 20 to a second position designated by 22*a*", however, to provide a desired curvature for the lumbar region of the flexible support member as shown by profile 12" and mattress, the shuttle 22*a* may be constrained by a stop 48 in the upper second position. Similarly, shuttle 22*b* is unconstrained in an upper initial position 22*b*' with the lumbar support retracted and upon rotation of the lumbar cam element 32 is drawn downward along the support arm 20 to a lower second position 22*b*". A stop 51 may be employed in to define the lower second position 22*b*". The initial positions of shuttles 22*a* and 22*b* are responsive to the position of the upper body portion of the flexible support member 12 as positioned by the angle of the support arms 20. The position stops may chosen to provide any desired profile by positioning of the shuttle as shown by an exemplary third lower position 22*a*'" and 22*b*'" with flexible support profile 12'".

Similarly, the stop 51 may limit downward travel of shuttle 22*b* in response to activation of the head angle cam element 34. As shown in FIG. 16 shuttle 22*b* may reside unconstrained in an upper initial position 22*b*' with the head angle in alignment with the upper body portion of the flexible support member. Upon rotation of the head angle cam element 34 to raise the head angle, shuttle 22*b* may translate downward to a lower second position 22*b*" with further downward translation of the shuttle constrained by stop 51.

The stops and shuttle positioning may additionally be adjustable for varying the curvature associated with the lumbar positioning element for different mattress thickness and/or stiffness as shown by positions 22*a*'" and 22*b*'".

Figure 17:
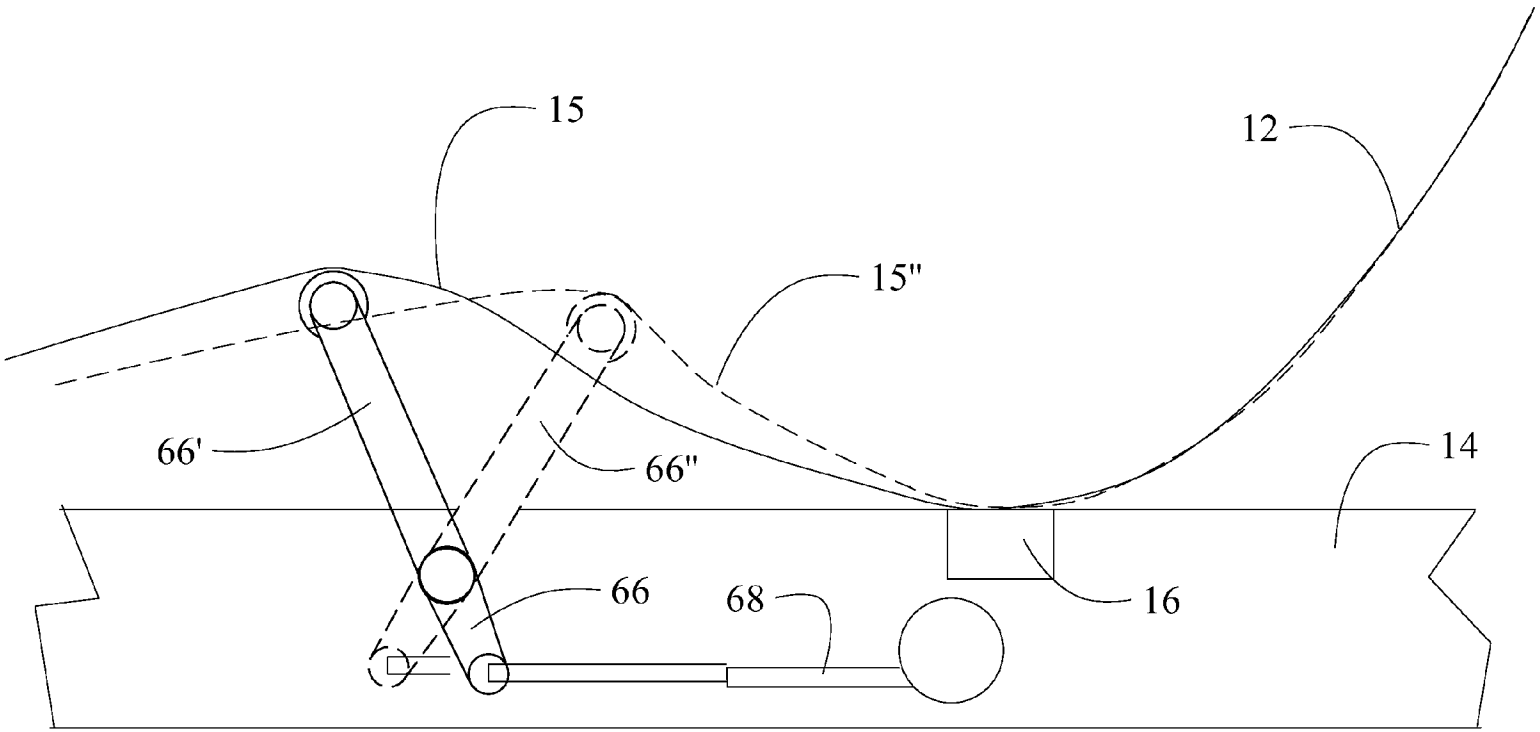

The lack of securing attachment of the flexible support member 12 to the leg portion adjustment member 24 additionally allows adjustment of the positioning of the knee bend in the flexible support member to accommodate the length of the user's thigh from hip to knee. When the articulating structure of the bed is adjusted for raising the upper body portion 13, the user naturally settles into a seated position at the curvature induced in the mattress. The length of the thigh then becomes the determining dimension desire for the knee bend location. Since this may vary significantly between tall and short users, conventional beds do not adequately provide for this variation. In the present embodiments, the longitudinal position of the leg portion adjustment member 24 may be adjusted to accommodate this length. Alternatively, a single lever actuation element 66 as shown in FIG. 17 may be employed to raise the flexible support member 12 at the knee position. Rotating the actuation element by an actuator 68 to a normal raised position 66' places the thigh portion 15 and lower leg portions in the rotated positions draped normally over the knee position. By rotating beyond the vertical to a position 66", a shortening of the knee position relative to the rigid cross member 16 is obtained thereby allowing for shorter length of the thigh portion 15". The natural height reduction created by the overcenter rotation of the actuation element 66 at position 66" further compensates for a shorter thigh length. As shown in FIG. 17, the actuation element 66 may employ a wheel 70 for engagement of the underside of the flexible support member 12.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed comprising:

a frame having side frame members and a rigid cross frame member extending between the side frame members;

a flexible support member secured to the rigid cross frame member with discs with bolts extending through the flexible support member and engaged in the rigid cross member to secure the flexible support member;

support arms engaging an upper body portion of the flexible support member with lubricious support, said support arms rotatable through a range of motion from an aligned position with the side frame members to a fully elevated position angularly supporting the upper body portion in a raised position;

a leg portion adjustment member engaging the flexible support member at a knee position intermediate a thigh portion and a leg portion of the flexible support member, the leg portion adjustment member rotatable through a range of motion from an aligned position with the side frame members to a fully elevated position placing the knee position at an elevated location with angular positioning of the thigh portion and leg portion.

2. The articulating bed as defined in claim 1 wherein the lubricious support comprises a plurality of shuttles movable on the support arms.

3. The articulating bed as defined in claim 1 further comprising:

a lumbar support element engaging the flexible support member for adjustable deformation of the flexible support member at a lumbar portion.

4. An articulating bed comprising:

a frame having side frame members and a rigid cross frame member extending between the side frame members;

a flexible support member secured to the rigid cross frame member;

support arms engaging an upper body portion of the flexible support member with lubricious support, said support arms rotatable through a range of motion from an aligned position with the side frame members to a fully elevated position angularly supporting the upper body portion in a raised position;

a leg portion adjustment member engaging the flexible support member at a knee position intermediate a thigh portion and a leg portion of the flexible support member, the leg portion adjustment member rotatable through a range of motion from an aligned position with the side frame members to a fully elevated position placing the knee position at an elevated location with angular positioning of the thigh portion and leg portion;

a lumbar support element engaging the flexible support member for adjustable deformation of the flexible support member at a lumbar portion wherein the lumbar support element comprises a rotatable cam element extending between the support arms and selectively rotatable from a first position without deformation of the flexible support member to a second position deforming the flexible support member outwards in the lumbar portion.

5. The articulating bed as defined in claim 1 further comprising:

a neck angle adjustment element engaging the flexible support member for adjusting the angle of a head portion.

6. The articulating bed as defined in claim 4 wherein the rotatable cam element comprises a plurality of cam segments mounted to a splined shaft for concerted rotation by the shaft from the first position to the second position.

7. The articulating bed as defined in claim 6 wherein the rotatable cam element further comprises a rotation lever mounted to the splined shaft.

8. An articulating bed comprising:

a frame having side frame members and a rigid cross frame member extending between the side frame members;

a flexible support member secured to the rigid cross frame member;

support arms engaging an upper body portion of the flexible support member with lubricious support, said support arms rotatable through a range of motion from an aligned position with the side frame members to a fully elevated position angularly supporting the upper body portion in a raised position;

a leg portion adjustment member engaging the flexible support member at a knee position intermediate a thigh portion and a leg portion of the flexible support member, the leg portion adjustment member rotatable through a range of motion from an aligned position with the side frame members to a fully elevated position placing the knee position at an elevated location with angular positioning of the thigh portion and leg portion;

a neck angle adjustment element engaging the flexible support member for adjusting the angle of a head portion having a rotatable cam element extending between the support arms and selectively rotatable from a first position with flush with the support arms to a second position extending outward from the support arms urging the head portion of the flexible support member into angled relation with the remainder of the upper body portion.

9. The articulating bed as defined in claim 8 wherein the rotatable cam element comprises a plurality of cam segments mounted to a splined shaft for concerted rotation by the shaft from the first position to the second position.

10. The articulating bed as defined in claim 9 wherein the rotatable cam element further comprises a rotation lever mounted to the splined shaft.

* * * * *